US008186870B2

(12) United States Patent
Baumfalk et al.

(10) Patent No.: US 8,186,870 B2
(45) Date of Patent: May 29, 2012

(54) DEVICE FOR AGITATING MEDIA

(75) Inventors: Reinhard Baumfalk, Gottingen (DE); Stefan Obermann, Adelebsen (DE); Christian Schmelig, Guxhagen (DE); Len Goren, Allentown, PA (US); Kenneth P. Clapp, Allentown, PA (US)

(73) Assignee: Sartorius Stedim Biotech GmbH (DE)

( * ) Notice: Subject to any disclaimer, the term of this patent is extended or adjusted under 35 U.S.C. 154(b) by 939 days.

(21) Appl. No.: 11/666,210

(22) PCT Filed: Oct. 18, 2005

(86) PCT No.: PCT/EP2005/011166

§ 371 (c)(1),
(2), (4) Date: Jun. 20, 2007

(87) PCT Pub. No.: WO2006/045477

PCT Pub. Date: May 4, 2006

(65) Prior Publication Data

US 2009/0225626 A1 Sep. 10, 2009

(30) Foreign Application Priority Data

Oct. 26, 2004 (DE) ..... 10 2004 052 156

(51) Int. Cl.
*B01F 11/00* (2006.01)
*B01F 15/00* (2006.01)

(52) U.S. Cl. ..... 366/142; 366/214

(58) Field of Classification Search ..... 366/142, 366/214

See application file for complete search history.

(56) References Cited

U.S. PATENT DOCUMENTS

| | | | | | |
|---|---|---|---|---|---|
| 2,662,752 | A * | 12/1953 | Miller et al. | 366/142 |
| 3,138,370 | A * | 6/1964 | Anderson et al. | 366/274 |
| 3,356,346 | A * | 12/1967 | Landsberger | 366/274 |
| 3,503,592 | A * | 3/1970 | Taylor et al. | 366/212 |
| 3,601,372 | A * | 8/1971 | Harmes | 366/219 |
| 3,780,992 | A * | 12/1973 | Nishi et al. | 366/114 |
| 3,997,272 | A * | 12/1976 | George | 356/246 |
| 4,293,643 | A * | 10/1981 | Ohtake et al. | 435/39 |
| 5,052,812 | A * | 10/1991 | Tannenbaum et al. | 366/209 |
| 5,409,312 | A * | 4/1995 | Fletcher | 366/208 |
| 5,511,879 | A * | 4/1996 | Fletcher | 366/208 |
| 5,564,826 | A * | 10/1996 | Neumann et al. | 366/219 |
| 5,577,837 | A | 11/1996 | Martin et al. | |
| 6,057,773 | A | 5/2000 | Shukla et al. | |
| 6,605,463 | B1 * | 8/2003 | Bader | 435/298.2 |
| 6,808,304 | B2 * | 10/2004 | Gebrian et al. | 366/110 |
| 6,991,766 | B2 * | 1/2006 | Roth et al. | 422/130 |
| 7,048,775 | B2 * | 5/2006 | Jornitz et al. | 95/1 |

(Continued)

FOREIGN PATENT DOCUMENTS

KR 2003-0073954 * 9/2003

(Continued)

*Primary Examiner* — Tony G Soohoo

(74) *Attorney, Agent, or Firm* — Gerald E. Hespos; Michael J. Porco

(57) ABSTRACT

The invention relates to a device for agitating media (1), which are located on a platform (3). Said device consists of a housing (2) with an agitation mechanism, which is used to agitate the platform (3) and at least one sensor (4, 5), which is connected to a control unit (7) that is equipped with an electronic sensor system (6). According to the invention, the sensor(s) (4, 5) and the electronic sensor system (6) are located on the platform (3) and communicate in a wireless manner with the fixed control unit (7).

17 Claims, 2 Drawing Sheets

U.S. PATENT DOCUMENTS

| | | | | |
|---|---|---|---|---|
| 2002/0032517 | A1* | 3/2002 | Buckelew et al. | 701/204 |
| 2003/0227394 | A1* | 12/2003 | Rothgeb et al. | 340/870.01 |
| 2003/0234730 | A1 | 12/2003 | Arms et al. | |
| 2004/0050836 | A1* | 3/2004 | Nesbitt et al. | 219/201 |
| 2004/0165474 | A1* | 8/2004 | Nesbitt et al. | 366/142 |
| 2004/0256328 | A1* | 12/2004 | Jornitz et al. | 210/739 |
| 2005/0027484 | A1* | 2/2005 | Baumfalk et al. | 702/185 |
| 2005/0063247 | A1* | 3/2005 | Krause | 366/111 |
| 2006/0187743 | A1* | 8/2006 | Carreras | 366/111 |
| 2006/0218991 | A1* | 10/2006 | Baumfalk et al. | 73/37 |
| 2007/0159920 | A1* | 7/2007 | Baumfalk et al. | 366/152.4 |
| 2007/0160500 | A1* | 7/2007 | Baumfalk et al. | 422/82.07 |
| 2007/0185472 | A1* | 8/2007 | Baumfalk et al. | 604/533 |
| 2009/0075362 | A1* | 3/2009 | Baumfalk et al. | 435/289.1 |
| 2009/0147617 | A1* | 6/2009 | Baumfalk et al. | 366/152.1 |
| 2010/0246317 | A1* | 9/2010 | Wilson | 366/142 |

FOREIGN PATENT DOCUMENTS

| | | | |
|---|---|---|---|
| WO | WO 98/32838 | A | 7/1998 |
| WO | WO 02/26386 | A2 | 4/2002 |
| WO | WO 02/101000 | A2 | 12/2002 |
| WO | WO 03/100153 | A1 | 12/2003 |
| WO | WO 2004/001373 | A2 | 12/2003 |

* cited by examiner

DEVICE FOR AGITATING MEDIA

BACKGROUND OF THE INVENTION

1. Field of the Invention

The invention relates to an apparatus for agitating media which are arranged on a shelf, comprising a housing with an agitating mechanism, which can be used to cause the shelf to make agitating movements, and with at least one sensor connected to a control unit which has sensor electronics.

2. Description of the Related Art

As far as media which are to be examined in the laboratory, for example for biological fermentation processes, and need to be kept in motion, this is done using laboratory shakers. The laboratory shakers have an essentially horizontal shelf which holds the medium to be examined, for example in an agitating flask. In this case, the shelf is caused to make a circular movement, a longitudinal movement or a tilting movement by an agitating mechanism arranged in a housing. In order to examine the medium kept in motion, sensors are used. In addition, with the increasing need to equip each agitating flask on a shelf with sensors or with a sensor system for variables such as oxygen content or pH value, in order just to collect data for the process development in this case, the shelf currently needs to accommodate ever more sensors with the associated wiring arrangements, sensor electronics and data lines.

One of the main problems for the indication of sensor systems on a laboratory agitator is the fact that the media to be examined need to be in motion, which means that it is necessary to transmit sensor signals from the sensors to the sensor electronics or to a control unit via permanently moving, kinked cables, which, particularly in the case of numerous measuring lines, presents an electromechanical problem as a result of possible cable fracture.

WO 02/101000 A2 discloses an agitating machine for biological fermentation. In the case of the known agitator, the sensors or measuring heads are arranged separately from the shelf, so that the shelf moves relative to the measuring heads. However, this is possible only using contactless, optical measuring methods and rules out arranging sensors on the shelf or on or in an agitating flask.

It is therefore an object of the present invention to specify an apparatus for agitating media, to monitor the one measurement-based monitoring of the media kept in motion, which are arranged on a shelf, particularly in agitating flasks, using sensors arranged on the shelf, and in so doing to avoid mechanical problems, such as cable fracture in measuring lines for processing measured values.

This object is achieved by virtue of the at least one sensor and the sensor electronics connected to the sensor being arranged on the shelf and communicating wirelessly with the fixed control unit.

SUMMARY OF THE INVENTION

The fact that the sensor electronics are arranged separately from the control unit and on the shelf means that between the sensor and the sensor electronics there are no movement problems with connecting cables to the sensors, since the sensor electronics are not subject to any relative movement relative to the sensors. The fact that the sensor electronics communicate wirelessly with the fixed (for example arranged on the housing) control unit means that there is no cable problem between the sensor electronics and the control unit either.

In line with one preferred embodiment of the invention, a plurality of sensors are arranged on the shelf, and the shelf has a central data bus provided on it which is used, with the aid of the sensor electronics, for the communication between sensors and a central interface on the shelf, where the central interface communicates wirelessly with a fixed interface, for example on the housing. The central data bus allows the communication between the sensors and the fixed control unit to be conducted wirelessely via just one central interface on the shelf and via the fixed interface corresponding to said central interface.

In accordance with another preferred embodiment of the invention, the central interface has a signal transmitter whose signals are received by a signal receiver on the fixed interface. In addition, the central interface has a communication receiver which receives signals from a communication transmitter on the fixed interface. The signal receiver and the communication transmitter on the fixed interface are connected to the control unit via a data line. The control unit has a microprocessor for the purpose of processing the measured data and for the purpose of control. Alternatively, the control unit may be formed by a computer.

In line with another preferred embodiment of the invention, measured signals from the sensors which have been collected and conditioned by the sensor electronics are routed to the central interface via the central data bus. The communication between the central interface and the fixed interface can in this case be conducted by means of the use of radio frequencies using the known RFID (Radio Frequency Identification) technology. Alternatively, wireless communication using the likewise known Bluetooth technology is possible.

In line with another preferred embodiment of the invention, the media are in agitating flasks arranged on the shelf. In this case, a wireless sensor next to the agitating flask is provided for the purpose of measuring the medium in an agitating flask. The wireless sensor may be in the form of an optical sensor in this case. It is also possible for a sensor to be in the form of a probe, which can be arranged in the agitating flask, with a wire link to the sensor electronics. The sensor electronics and/or mechanics may in this case also be physically accommodated in the shelf. The underside of the shelf may in this case be configured such that it has the dimensions and critical points of commercially available agitator shelves, so that laboratory shakers can easily be installed and retrofitted. The surface of the shelf may be equipped with the usual patterns of threaded holes, so that customary holders or coasters for agitating flasks can be installed.

In line with another preferred embodiment of the invention, the sensors and the sensor electronics on the shelf are supplied with power wirelessly. This has the advantage that no problems with cables which need to move arise when supplying power or voltage either. Since the reaction of a voltage supply is far less sensitive toward disturbances on account of interruptions in comparison with data lines, and only two moving cables would be required in order to supply power, it would also be possible in principle to use a wired link.

In accordance with another preferred embodiment of the invention, a fixed power transmitter is provided on the housing and a power receiver is provided on the shelf. In this case, the power could be transmitted inductively or by an RFID link. Particularly in the case of a circular movement of the shelf, it is possible to supply the sensors and the sensor electronics with power using a generator which is driven by the movement of the shelf.

It is also advantageous to use a power-saving sensor technology, i.e. optical and/or miniaturized measuring technology.

Further details of the invention can be found in the detailed description below and in the appended drawings, which illustrate preferred embodiments of the invention by way of example.

DETAILED DESCRIPTION OF THE PREFERRED EMBODIMENTS

Figure 1:
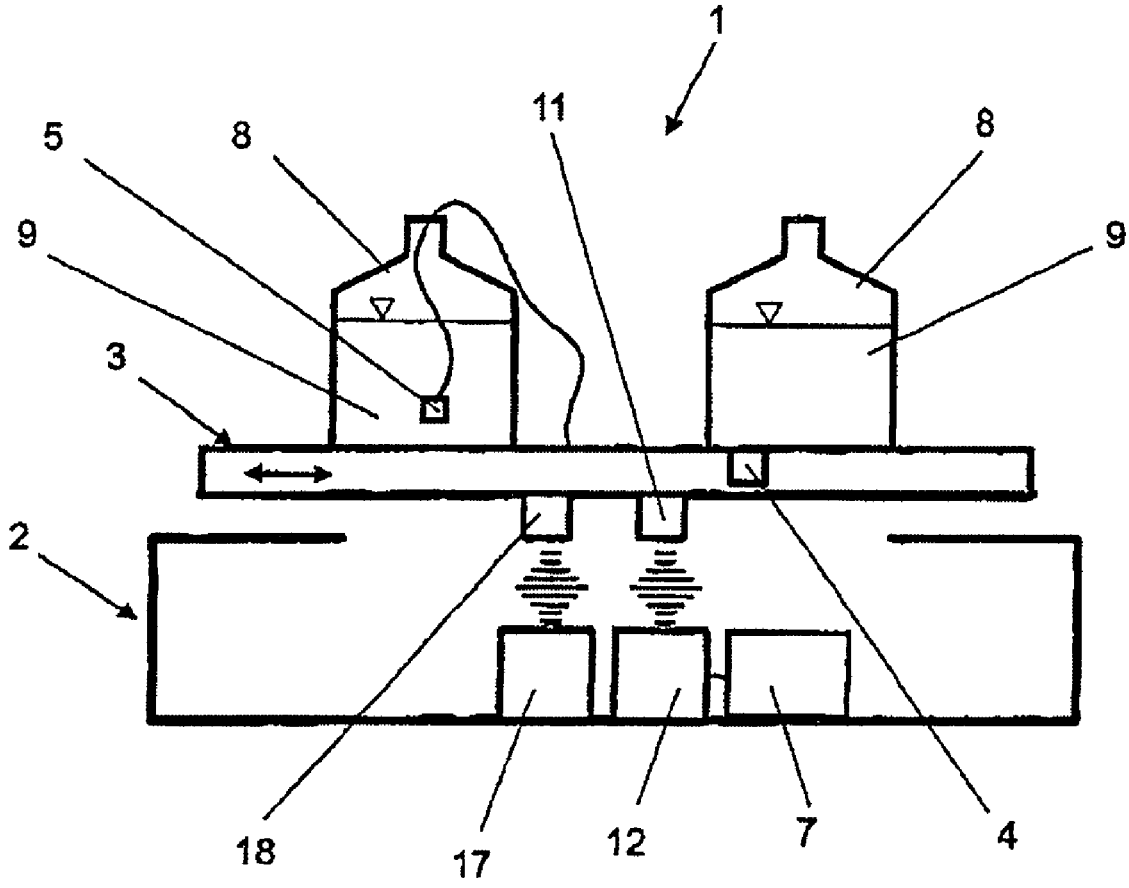
FIG. 1 shows a schematic illustration of an apparatus for agitating media.
Figure 2:
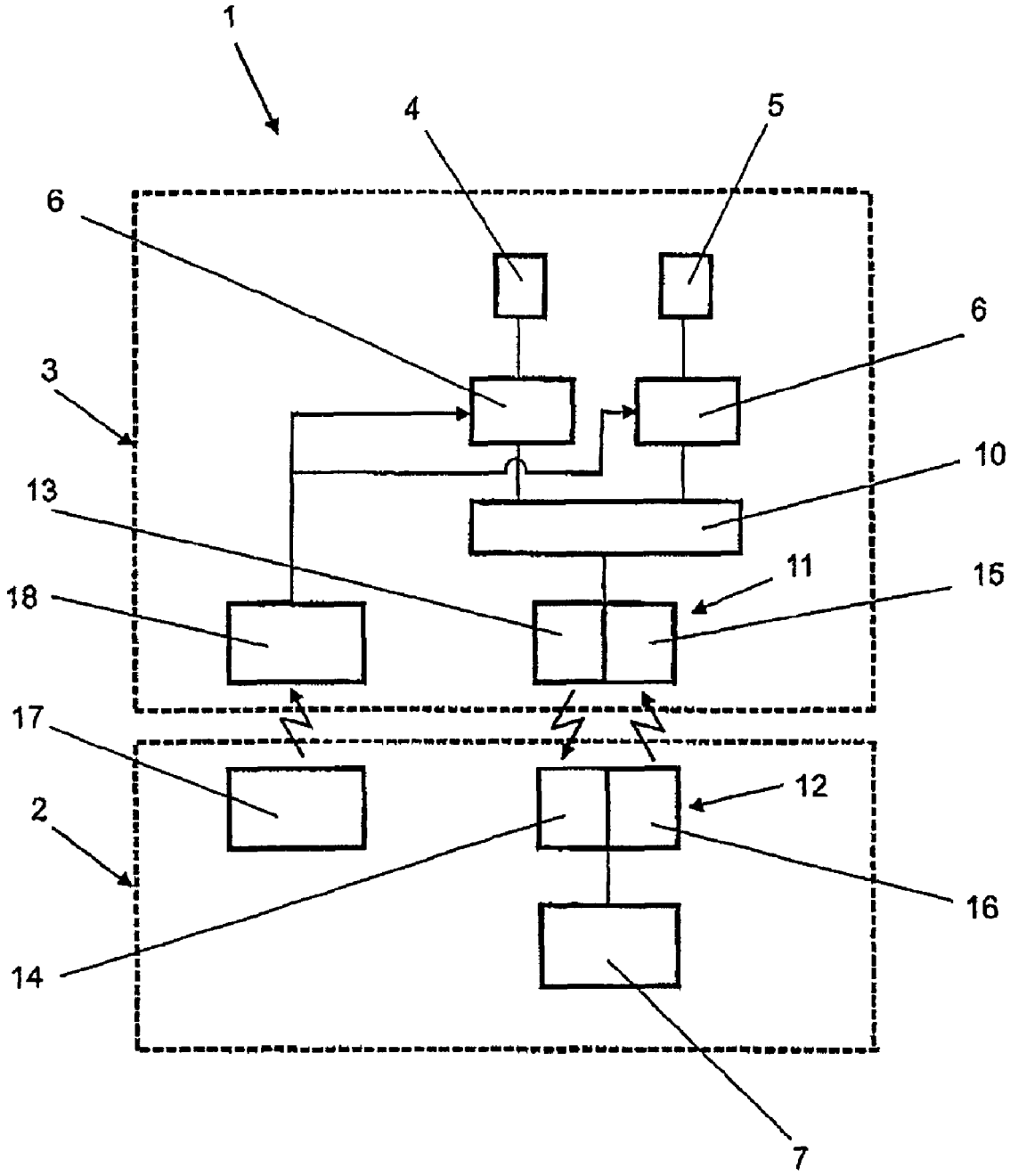
FIG. 2 shows a block diagram of an apparatus for agitating media.

An apparatus 1 for agitating media essentially comprises a housing 2, a shelf 3, sensors 4, 5, sensor electronics 6 and a control unit 7.

In this arrangement, the housing 2 has an agitating mechanism (not shown further) which causes the shelf 3 to make agitating movements. In this context, the agitating movement may be a circular movement, a horizontal or vertical longitudinal movement, a tilting movement or a combination of movements.

The shelf 3 has customary holders (not shown) fitted on it for holding the agitating flasks 8 which contain the medium 9 which is to be agitated.

The shelf 3 has wireless sensors 4, which are in the form of optical sensors and are arranged next to the agitating flasks 8, for example, and also wired sensors 5. The wired sensors 5 are in the form of probes which can be inserted into the agitating flasks 8, for example.

The sensors 4, 5 are connected to the sensor electronics 6 integrated in the shelf 3. Measured signals from the sensors 4, 5 are collected by the respectively associated sensor electronics 6, are conditioned and are supplied via a central data bus 10 to a central interface 11 which is likewise arranged on the shelf 3. The central interface 11 conducts wireless communication with a fixed interface 12, which is arranged on the housing 2 in the example. The communication between the central interface 11 and the fixed interface 12 takes place on the basis of RFID (Radio Frequency Identification) technology in the example. This allows rapid and automatic data capture by means of radio waves, for example using transponders and appropriate readers and transmitters. The communication between the central interface and the fixed interface can also take place by radio on the basis of the known Bluetooth interface standard.

The fixed interface 12 is connected to the control unit 7 by means of a wire link. The control unit 7 may also be in the form of a separate PC. The control unit 7 can send control signals to the sensor electronics 6 or to the sensors 4, 5 in a corresponding, opposite direction.

The central interface 11 has a signal transmitter 13 whose signals are received by a signal receiver 14 on the fixed interface 12. The central interface 11 also has a communication receiver 15 which receives signals from a communication transmitter 16 on the fixed interface 12.

The sensors 4, 5 and the sensor electronics 6 are supplied with power wirelessly by means of a power transmitter 17 fixed on the housing 2 and a power receiver 18 arranged on the shelf 3. In this case, power can be supplied and transmitted via an RFID link. In principle, inductive power transmission is also possible, however. It is also possible for the sensors 4, 5 and the sensor electronics 6 to be supplied with power by means of a generator (not shown) which is driven by the movement of the shelf 3.

The invention claimed is:

1. An apparatus for agitating media comprising:

at least one container (8) containing the media, a shelf (3) for supporting the at least one container (8) containing the media, a fixed housing (2) with an agitating mechanism, which can be used to cause the shelf (3) to make agitating movements relative to the fixed housing (2), at least one sensor (4, 5), sensor electronics (6) and a central interface (11) connected to one another and arranged on the shelf (3), the at least one sensor (4, 5), the sensor electronics (6) and the central interface (11) being fixedly arranged relative to the at least one container (8) and the shelf (3), the central interface (11) on the shelf (3) including a signal transmitter (13), and the fixed housing (2) including a fixed control unit (7) and a fixed interface (12) with a signal receiver (14) that communicates wirelessly with the signal transmitter (13) on the shelf for receiving signals from the sensor (4, 5), the fixed control unit (7) being spaced from the shelf (3) and receiving the signals from the signal receiver (14).

2. The apparatus as claimed in claim 1, characterized in that the at least one sensor (4, 5) comprises a plurality of sensors (4, 5) arranged on the shelf (3), in that the shelf (3) has a central data bus (10) provided on it which is used, with the aid of the sensor electronics (6), for the communication between the sensors (4, 5) and the central interface (11) on the shelf (3).

3. The apparatus as claimed in claim 2, characterized in that the central interface (11) has a communication receiver (15) which receives signals wirelessly from a communication transmitter (16) on the fixed interface (12), said communication transmitter being connected to the control unit (7).

4. The apparatus as claimed in claim 3, characterized in that the fixed interface (12) is connected to the control unit (7) via a data line.

5. The apparatus as claimed in claim 4, characterized in that the control unit (7) is formed by a computer.

6. The apparatus as claimed in claim 2, characterized in that measured signals from the sensors (4, 5) which have been collected and conditioned by the sensor electronics (6) can be routed to the central interface (11) via the central data bus (10).

7. The apparatus as claimed in claim 1, characterized in that the wireless communication is produced by means of RFID technology.

8. The apparatus as claimed in claim 1, characterized in that the at least one container (8) comprises a plurality of agitating flasks (8) and in that the media (9) are in agitating flasks (8) arranged on the shelf (3).

9. The apparatus as claimed in claim 8, characterized in that the at least one sensor (4, 5) comprises a wireless sensor (4) next to at least one of the agitating flasks (8) for measuring the medium (9).

10. The apparatus as claimed in claim 9, characterized in that the wireless sensor (4) is an optical sensor.

11. The apparatus as claimed in claim 8, characterized in that the at least one sensor (4, 5) is a probe (5), which can be arranged in the agitating flask (8), with a wire link to the sensor electronics (6).

12. The apparatus as claimed in claim 1, further comprising a power supply for the sensors (4, 5) and for the sensor electronics (6).

13. The apparatus as claimed in claim 12, characterized in that a fixed power transmitter (17) is provided on the housing (2) and a power receiver (18) is provided on the shelf (3), the fixed power transmitter (17) transmitting power wirelessly to the power receiver (18).

14. The apparatus as claimed in claim 12, characterized in that an inductive power supply is provided.

15. The apparatus as claimed in claim 14, characterized in that an RFID link is installed for the power supply.

16. The apparatus as claimed in claim 1, characterized in that a generator which can be driven by the movement of the shelf (3) is provided for the power supply for the sensors (4, 5) and for the sensor electronics (6).

17. The apparatus as claimed in claim 1, wherein the at least one container (8) comprises a plurality of agitating flasks (8) arranged on the shelf (3), the at least one sensor (4, 5) comprises a plurality of wireless optical sensors (4) arranged in proximity to the respective flasks on the shelf and a plurality of probes (5) connected by wire links to the sensor electronic (6) and disposed in the respective containers (8).

* * * * *